United States Patent [19]

Panhke et al.

[11] Patent Number: 4,535,677

[45] Date of Patent: Aug. 20, 1985

[54] DRUM MAGAZINE FOR LARGE-CALIBER AMMUNITION

[75] Inventors: Klaus-Dieter Panhke, Hilden; Wilfried Becker, Duesseldorf, both of Fed. Rep. of Germany

[73] Assignee: Rheinmetall GmbH, Duesseldorf, Fed. Rep. of Germany

[21] Appl. No.: 512,452

[22] Filed: Jul. 11, 1983

[30] Foreign Application Priority Data

Jul. 21, 1982 [DE] Fed. Rep. of Germany ..... 3227214

[51] Int. Cl.[3] ..... F41F 9/00

[52] U.S. Cl. ..... 89/46; 89/34

[58] Field of Search ..... 89/33.02, 33 D, 33.04, 89/33 SF, 33.1, 33 B, 34, 45, 46, 47

[56] References Cited

U.S. PATENT DOCUMENTS 2,437,425 3/1889 Goodhue et al. .

3,376,785 4/1968 Elwin ..... 89/46

FOREIGN PATENT DOCUMENTS 2413983 3/1974 Fed. Rep. of Germany .

*Primary Examiner*—Stephen C. Bentley

[57] ABSTRACT

An improved drum magazine for large caliber ammunition. The drum magazine has a peripheral cover in which a plurality of extracting openings are disposed. An extraction mechanism is adapted to extract via the extraction opening the radially outermost of a plurality of juxtaposed cartridges radially arranged in each ammunition chamber of a plurality of ammunition chambers exchangeably mounted in said drum magazine. The ammunition chambers are independently exchangeably mounted in the drum magazine. Each ammunition chamber defines a storage space for storing a plurality of radially juxtaposed cartridges therein.

11 Claims, 5 Drawing Figures

DRUM MAGAZINE FOR LARGE-CALIBER AMMUNITION

BACKGROUND OF THE INVENTION

The invention relates to a drum-magazine for large caliber ammunition. Drum magazines for storing large caliber ammunition of the same type or even of different type are known. Such drum magazines are, for example, described in German published patent application No. 241 3983. The ammunition storage capacity of this type of ammunition drum magazine is very limited. After firing a predetermined type of ammunition the thereafter emptied magazine parts must be resupplied with ammunition or the drum magazine as a whole must be exchanged for another fully loaded magazine.

Exchangeable ammunition magazines (containers) for large caliber ammunition are also known and described in the prior art (see for example U.S. Pat. No. 2,437,425). Whereas a postloading of the known drum magazines is very difficult under combat conditions, it seems that a complete exchange of a not yet fully fired magazine is also impractical because of cost considerations.

SUMMARY OF THE INVENTION

It is an object of this invention to provide an improved drum magazine for large caliber ammunition which has an increased storage space even if different types of ammunitions are stored in the same magazine. The improved ammunition storage drum of the invention is capable, after use of a predetermined type of ammunition, of being easily and rapidly reloaded without requiring an exchange of the still partially loaded magazine.

BRIEF DESCRIPTION OF THE DRAWING

With these and other objects in view, which will become apparent in the following detailed description, the present invention, which is shown by example only, will be clearly understood in connection with the accompanying drawing in which.

DETAILED DESCRIPTION

Figure 1:
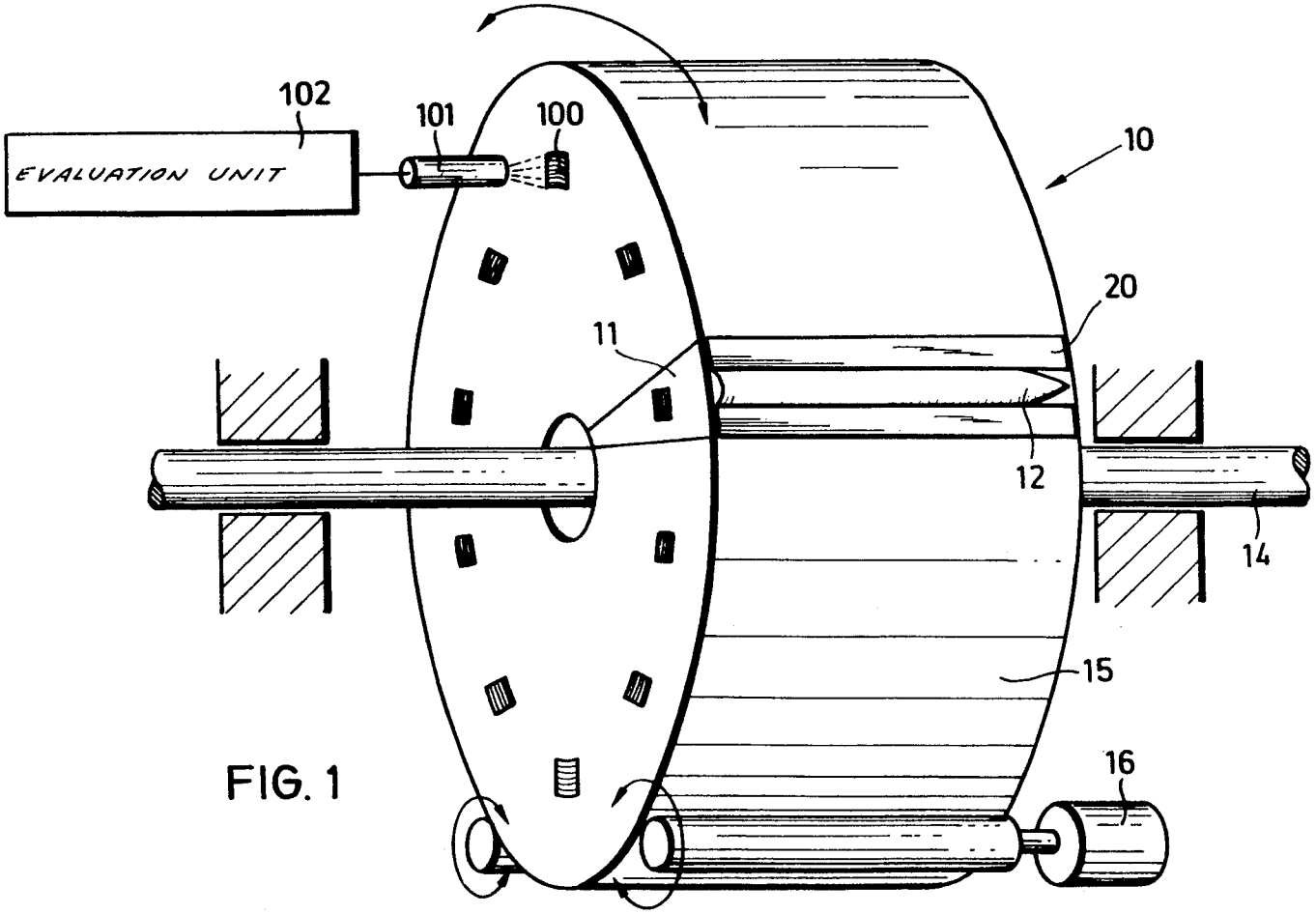
FIG. 1 is a schematic view in perspective of a drum magazine in accordance with this invention.

FIG. 1 illustrates in a schematic manner (without illustrating non-essential non-inventive constructional details of the drum magazine and the weapon in which it is mounted). The drum magazine 10 of the invention is adapted to store large caliber ammunition 12. The magazine 10 includes independently exchangeable ammunition chambers 11, each of which has a storage space for a plurality of cartridges 12 mounted one behind the other in a radial direction. Only one of the ammunition chambers 11 is illustrated schematically in FIG. 1. As can be noted this ammunition chamber 11 can, for example, be constructed in the form of a circular sector and can, by means not illustrated in the drawing, be snapped into the drum 10 in such a way that the ammunition chambers 11 can be randomly exchanged with other ammunition chambers 11. The drum magazine 10 is rotatably mounted on a central shaft 14 and can, for example, by means of frictional drives 16, acting on the outer peripheral surface 15 of the drum 10, be rotated in either rotational direction.

Figure 2:
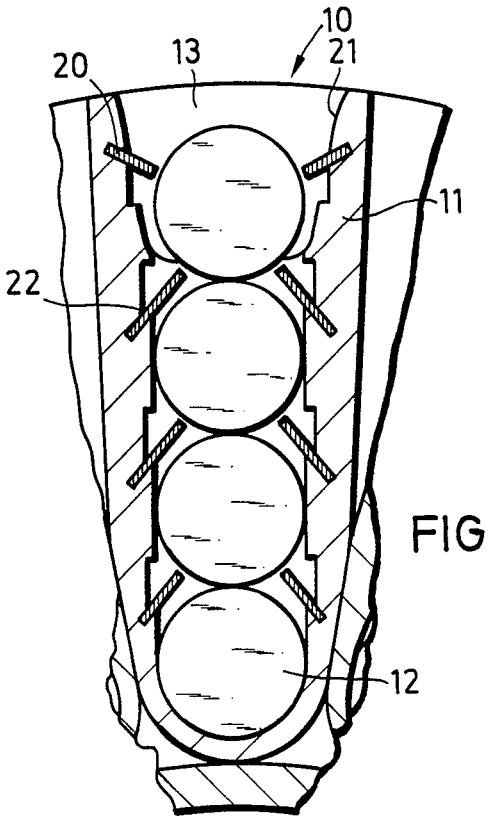
FIG. 2 is a partial side elevational view, partially in cross-section, of a segment-like portion of a drum magazine in accordance with FIG. 1.

In each separately exchangeable ammunition chamber 11 (FIG. 2) there are mounted a plurality of large caliber ammunition 12, stacked in a radial direction (FIG. 2), preferably in the form of cartridges 12 of large caliber ammunition, access to which can be obtained by at least one extraction opening 13 which is accessible from the outer peripheral surface 15. The cartridge 12 which is closest in the radial direction to the outer periphery of the drum 10 assumes the extraction position, whereas the more inwardly disposed cartridges 12 in the radial direction assume first a storage position and only then advance to an extraction position. In order to at least partially close the extraction opening 13 of the ammunition chamber 11, two spring leaves 20 (FIG. 1, FIG. 2) are provided, which are oppositely disposed along the longitudinal sides 21 of the ammunition chamber 11 and are inclined in such a way so as to form an inverted gable, so that the angle formed by the two leaf springs is inclined inwardly in the radial direction. The spring leaves 20 prevent in a simple manner the unintentional dropping out of a cartridge 12 which is disposed in the extraction position. As will be explained hereinafter, the blocking effect of the spring leaves 20 can only be removed by means of a suitable extraction arrangement. In order to limit their removal and maintain in storage position the stored cartridges 12, which are stored one above the other in a radial direction within the ammunition chamber 11, there is provided for each storage space, respectively each to be stored cartridge 12, a pair of spring leaves 22. Each pair of spring leaves 22 is arranged gable-like and forms an angle the apex of which is inclined outwardly in the radial direction. These springs leaves 22 assure that the stored cartridges 12 advance stepwise successively towards the extraction openings 13. The advance is effected by the centrifugal force effect caused by the rotation of the drum magazine 10. A return retraction of a cartridge 12 which has been advanced in the direction towards the extraction position towards a previously occupied storage position is reliably prevented by the gable-like construction formed by each pair of spring leaves 22.

Figure 3:
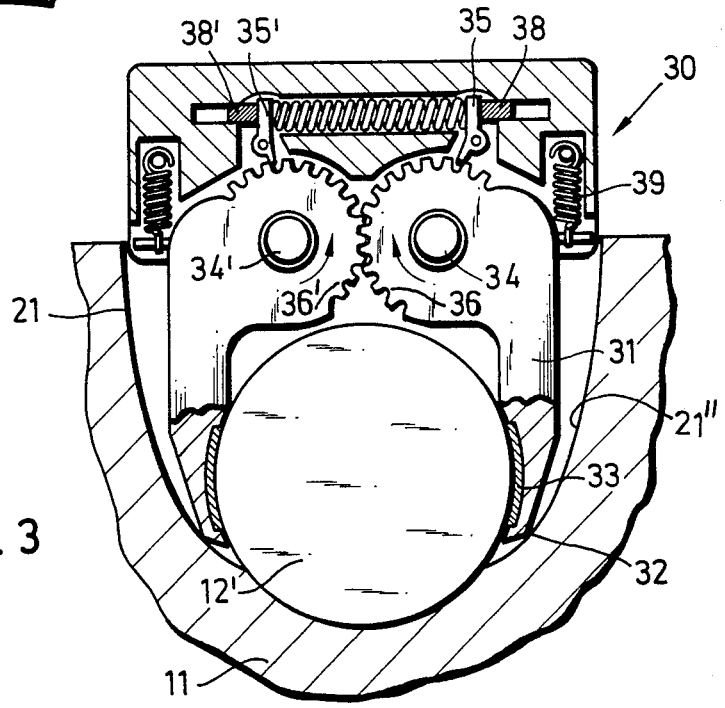
FIG. 3 is a side elevational view, partially in cross section, of a portion of a drum magazine and including an extraction arrangement forming a first embodiment of the invention.
Figure 4:
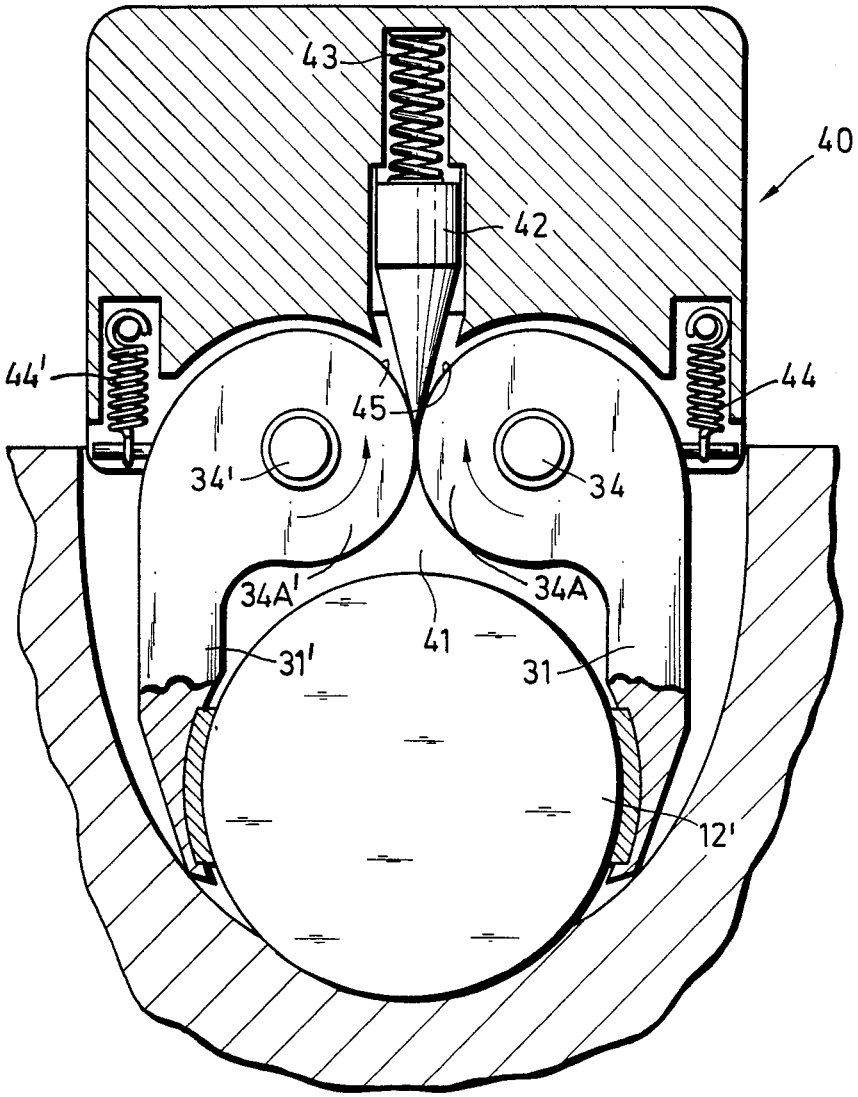
FIG. 4 is a side elevational view, partially in cross-section, of a portion of drum magazine with a second type of extraction arrangement forming a second embodiment of the invention.

The cartridges 12 which are disposed in the extraction position are removed by an extraction arrangement from the ammunition chamber 11 in accordance with the embodiments of such arrangement illustrated respectively in FIGS. 3 and 4. This extraction arrangement advantageously coacts with a loading arrangement for a large-caliber weapon. The extraction arrangement 30, 40 encompasses two gripper arms 31, which, for purposes of extracting a cartridge 12', disposed in the extraction position, can be introduced into the extraction opening 13. The longitudinal sides 21 of the ammunition chamber 11 are curvingly shaped in their upper region, adjacent to the extraction opening 13, as guide cam surfaces 21', so that when the gripper arms 31 contact these curved cam surfaces 21' with their outer curved contours 32 and slide there along, they are moved towards each other into a working position thereby clamping the cartridge 12' therebetween. For purposes of securely gripping the cartridge 12', the gripping surfaces of the gripper arms 31 are provided with adhering elements 33. Such adhering elements 33 can be formed by roughened synthetic inserts or metallic inserts having a serrated gripping surface. In the working position the gripper arms 31 encompass the to be extracted cartridge 12' and facilitate its removal from the ammunition chamber 11 and its transport to the gun barrel. The blocking effect which is achieved by the outermost pair of spring leaves 20 to prevent the inadvertent falling out of a cartridge 12' disposed in the extraction position, is temporarily removed when the gripper arms 31 are introduced into the ammunition chamber 11, which gripper arms cause the pair of leaf springs 20 to be pushed against the walls of the ammunition chamber so that the locking effect is thereby temporarily removed.

In order to assure a secure transporting of the extracted cartridge 12' from the gun barrel, the working position of the gripper arms 31 is fixed at least temporarily by means of suitable locking means. In the embodiment of FIG. 3 the extracting arrangement comprises the gripper arms 31 which are swingably mounted on separate gripper arms 34, 34', and meshingly engage each other via arcuate toothed segments 36, 36'. The swingable movement of the toothed segments 36, 36', and thereby the gripper arms 31, 31' can be blocked by means of locking pawls 35, 35'; the locking pawls 35, 35' in turn can be fixed in their position by means of stops 38, 38', which, after termination of the ammunition transport, can be moved outwardly by non-illustrated mechanical, pneumatic or hydraulic means, thereby releasing the locking pawls 35, 35'. In the embodiment of FIG. 4 the extraction arrangement also includes the gripper arms 31, 31' which are also mounted on separate axles 34, 34' and are in mutual contact in the region 41 via frictional contact surfaces 34A, 34A'. In this contacting region 41, the rollingly contacting surfaces 34A, 34A' of the gripper arms 31 can advantageously be clad with a surface of improved frictional properties, for example a synthetic material layer. In order to attain the working position, in which the gripper arms 31, as has been described hereinabove, clamp between them the to be extracted cartridge 12', and for purposes of preventing an uncontrolled spreading apart of the gripper arms 31, there is provided a braking cone 42 which is biased by a coil spring 43 against the rollingly contacting surfaces 34A, 34A' of the gripper arms 31, 31' in their contacting region 41. This braking cone 42 can again, after termination of the ammunition transport, be returned to its inoperative position by mechanical, hydraulic or pneumatic non-illustrated means, whereupon the gripper arms 31 swing outwardly and release the previously grippingly held cartridge 12'. The releasing swinging movement of the gripper arms 31, 31' is again aided by tension coil springs 44, 44' each one of which is operatively connected to the corresponding axle 34, 34'.

Figure 5:
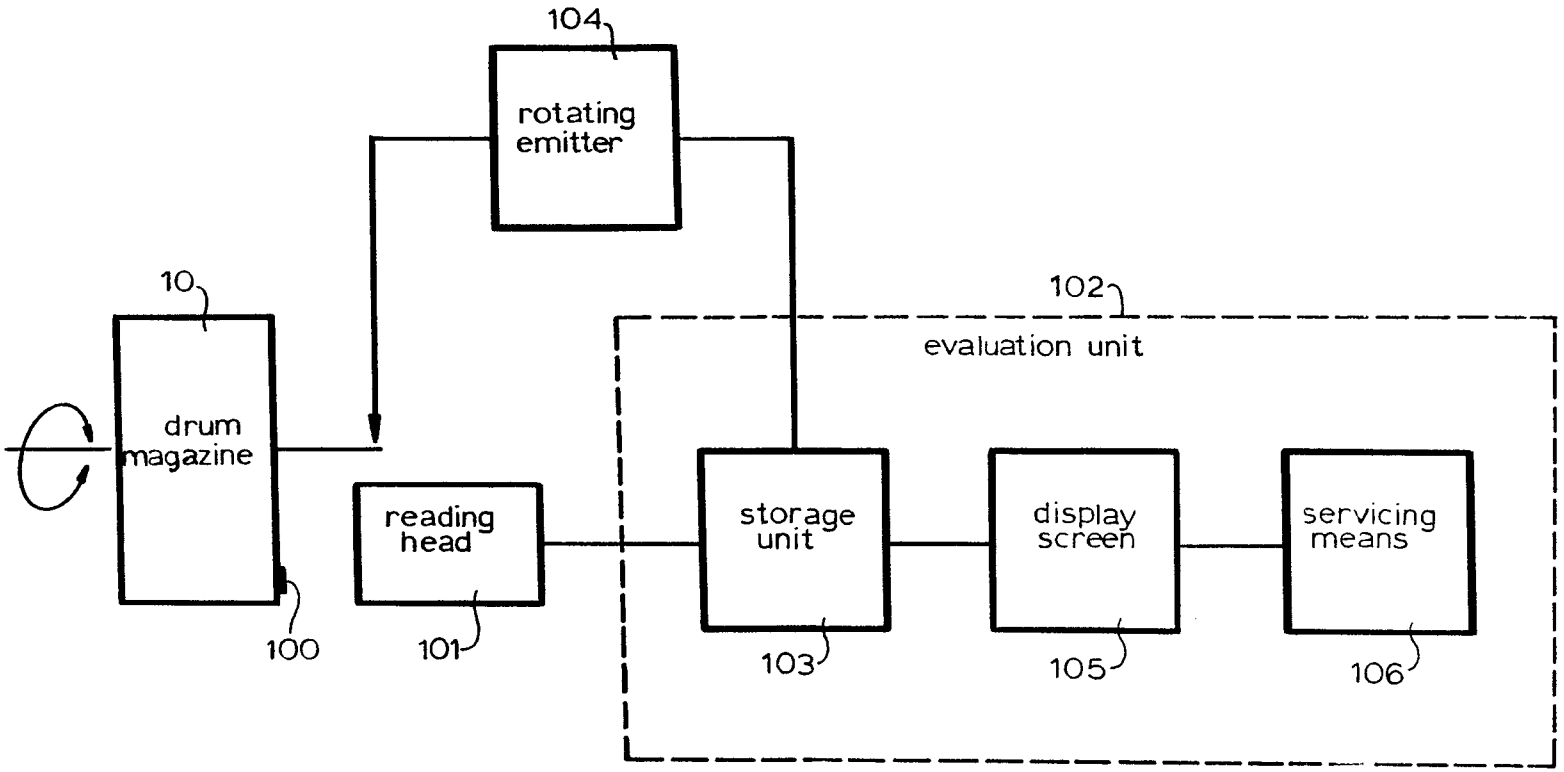
FIG. 5 is a block circuit diagram illustrating the manner of reading markings on the drum magazine of the invention.

The prevailing loading condition of the drum magazine 10 can be monitored in an advantageous manner by an electronic switching arrangement (FIG. 5). This electronic switching arrangement indicates at all times by suitable indicia means to the personnel serving the weapon the still available stored ammunition and, in certain instances after complete exhaustion of a predetermined type of ammunition, may give a warning signal.

Different types of ammunition may be stored in the drum magazine 10. Advantageously each one of the independently exchangeable ammunition chambers 11 can receive a particular type of ammunition. Types and numbers of ammunition can be indicated by suitable marking 100 on each filled ammunition chamber 11, which marking may be fixedly joined to the ammunition chamber 11, and which, after snapping in the ammunition chamber 11 into the drum magazine 10 (FIGS. 1, 5) is readable by a reading head 101 which is preferably of the electro-optical type. The reading head 101 converts the coded information regarding type and number of ammunition present in the ammunition chamber 11 into suitable electrical signals which are further processed in an evaluation unit. The evaluation unit 102 includes first of all a storage unit 103, which, on the one hand, stores the data received by way of the markings 100 and the reading head 101, and on the other hand, determines and ascertained the angular position of the drum magazine 10 via a rotating emitter 104, and coordinates the angular position with the markings 100. By means of further sensors (not illustrated in FIG. 5), which for example can be actuated by the extracting arrangement 30, 40, respectively the released leaf springs 20, there is conducted to the storage means 103 additional information concerning the extracting processes, so that by the differential formation of the prevailing actual loading condition of the ammunition chamber 11 there is available a pictorial representation on a display screen 105. The evaluation unit 102 can, advantageously, be adjusted in such a way that on the display screen 105 there is indicated a warning signal no later than when a particular type of ammunition is fully exhausted. A warning signal can then already be given and the amount of a particular type of stored ammunition falls under a minimum predetermined amount.

The personnel servicing the weapon can then decide whether the weapon is to be used with the remaining stored ammunition or whether precautionarily the emptied ammunition chambers 11 are to be exchanged for filled ammunition chambers.

By servicing means 106 the personnel servicing the weapon can select which type of ammunition during the next operative step of the extracting arrangement 30 is to be removed from one of the ammunition chambers 11. The evaluation unit 102, in the storage means 103 of which all necessary information concerning the supplying of the ammunition chamber 11 is contained, is then effective, by a suitable rotational movement of the drum magazine 10 to bring the next to be attained ammunition chamber 11 with the preselected type of ammunition is in ready position for extraction of the cartridge.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An improved drum magazine for large caliber ammunition having an outer peripheral cover in which at least one extraction opening is disposed and including extraction means adapted to selectively extract the outermost of a plurality of cartridges disposed in said drum magazine, the improvement comprising in combination, a plurality of ammunition chambers exchangeably mounted in said drum magazine independently from each other, each ammunition chamber defining a storage space for a plurality of radially juxtaposed cartridges.

2. The improved drum magazine for large caliber ammunition as set forth in claim 1, wherein each ammunition chamber includes one extraction opening, and means mounted in each chamber which, on the one hand, block said extraction opening when said ammunition chamber is in an inoperative position and, on the other hand, permit a radially outward bias of cartridges stored in said ammunition chamber.

3. The improved drum magazine for large caliber ammunition as set forth in claim 2, wherein each chamber has a pair of opposite longitudinal sides, said means mounted on each chamber includes a first pair of leaf springs respectively mounted in opposite longitudinal sides of each chamber so as to confront each other, said leaf springs of said first pair of leaf springs being inclined towards each other so as to form an angle therebetween the apex of which points radially inwardly and is adapted to limit the radially outward movement of the cartridge disposed in said chamber in an extraction position.

4. The improved drum magazine for large caliber ammunition as set forth in claim 3, wherein said means mounted in each chamber further includes at least one second pair of leaf springs adapted to biasingly engage each cartridge stored in each chamber and bias it towards said extraction opening, each leaf spring of said second pair of leaf springs respectively mounted in opposite longitudinal sides of each chamber radially inwardly relative to said first pair of leaf springs, and each leaf spring of said second pair of leaf springs being inclined towards each other so as to form an angle therebetween the apex of which points radially outwardly.

5. The improved drum magazine for large caliber ammunition as set forth in claim 4, wherein said extraction means includes a pair of gripper arms which are adapted to be introduced into said extraction opening for the purpose of gripping a cartridge disposed in said extraction position; the most radially outward region of said longitudinal sides of each chamber having a curved surface which is adapted to coact with a gripper arm by contacting a portion of the outer surface of the gripper arm and bias it against a cartridge disposed in said extraction position so as to clamp said cartridge therebetween.

6. The improved drum magazine for large caliber ammunition as set forth in claim 5, wherein the surface of each gripper arm which confronts said cartridge in said extraction position is formed by an adhering material.

7. The improved drum magazine for large caliber ammunition as set forth in claim 6, wherein said pair of gripper arms are adapted to move from an inoperative position to an operative position in which said pair of gripper arms grip a cartridge disposed in the extraction position and vice-versa, said extraction means including locking means which are adapted to selectively lock said pair of gripper arms in their operative position.

8. The improved drum magazine for large caliber ammunition as set forth in claim 7, wherein said gripper arms of said pair of gripper arms are swingably mounted on separate parallel axes, each gripper arm of said pair of gripper arms has a toothed segment which meshingly engages the toothed segment of the other gripper arm; and a pair of ratchets is operatively mounted in said extraction means, each ratchet of said pair is adapted to selectively lockingly engage a corresponding toothed segment.

9. The improved drum magazine for large caliber ammunition as set forth in claim 7, wherein said gripper arms of said pair of gripper arms are swingably mounted on separate parallel axes and frictionally contact each other in a common contacting region via respective curved contracting surfaces, a braking cone having a coil spring operatively mounted thereon for biasing said braking cone against the curved contacting surfaces in said common contacting region.

10. The improved drum magazine for large caliber ammunition as set forth in claim 7, wherein each ammunition chamber includes indicia for indicating the type and number of the ammunition stored therein.

11. The improved drum magazine for large caliber ammunition as set forth in claim 10, including a reading head for reading said indicia on said ammunition chamber, and an evaluation unit operatively connected to said reading head for processing the information read by said reading head.

* * * * *

UNITED STATES PATENT AND TRADEMARK OFFICE

CERTIFICATE OF CORRECTION

PATENT NO. : 4,535,677

DATED : August 20, 1985

INVENTOR(S) : Klaus-Dieter PAHNKE, et al

It is certified that error appears in the above-identified patent and that said Letters Patent is hereby corrected as shown below:

Title page:

The last name of the first inventor should read --PAHNKE--.
Item [19] should read --Pahnke et al.--.

Signed and Sealed this

Twenty-first Day of October, 1986

[SEAL]

*Attest:*

DONALD J. QUIGG

*Attesting Officer*

*Commissioner of Patents and Trademarks*